US005893666A

United States Patent [19]

Aslam et al.

[11] Patent Number: 5,893,666

[45] Date of Patent: Apr. 13, 1999

[54] COOLING AND REUSING THE HEAT TO PREHEAT THE FUSING WEB IN A BELT FUSER

[75] Inventors: Muhammed Aslam; Fangsheng Wu, both of Rochester, N.Y.

[73] Assignee: Eastman Kodak Company, Rochester, N.Y.

[21] Appl. No.: 08/992,060

[22] Filed: Dec. 17, 1997

[51] Int. Cl.[6] ..... G03G 15/20

[52] U.S. Cl. ..... 399/329; 219/216

[58] Field of Search ..... 399/329, 322, 399/323; 219/216; 430/126

[56] References Cited

U.S. PATENT DOCUMENTS

| | | |
|---|---|---|
| 5,157,447 | 10/1992 | Farnand et al. . |
| 5,164,782 | 11/1992 | Nagayama et al. . |
| 5,235,393 | 8/1993 | Merle . |
| 5,256,507 | 10/1993 | Aslam et al. . |
| 5,307,133 | 4/1994 | Koshimizu et al. . |
| 5,319,429 | 6/1994 | Fukuchi et al. . |

FOREIGN PATENT DOCUMENTS

| | | |
|---|---|---|
| 4-216580 | 8/1992 | Japan . |
| 4-366874 | 12/1992 | Japan . |
| 5-046050 | 2/1993 | Japan . |

*Primary Examiner*—Matthew S. Smith
*Attorney, Agent, or Firm*—Lawrence P. Kessler

[57] ABSTRACT

A belt fusing apparatus for providing image gloss to a colorant image formed on a receiver member by a reproduction apparatus. The belt fusing apparatus includes a heated fuser roller, a pressure roller in nip relation with the fuser roller, and a steering roller. A fusing belt is entrained about the fuser roller and the steering roller for movement in a predetermined direction about a closed loop path. A cooling air flow is directed at the fusing belt over an area adjacent to the steering roller upstream of the steering roller. The cooling air flow, heated by the action of the air flow cooling the fusing belt, is captured and directed at the fusing belt downstream of the steering roller to preheat the fusing belt.

6 Claims, 3 Drawing Sheets

COOLING AND REUSING THE HEAT TO PREHEAT THE FUSING WEB IN A BELT FUSER

CROSS-REFERENCE TO RELATED APPLICATIONS

U.S. Pat. Appl. Ser. No. 08/992,872, filed Dec. 17, 1997 entitled "REPRODUCTION APPARATUS PROVIDING SELECTABLE IMAGE QUALITY AND GLOSS" in the name of Muhammed Aslam et al.

U.S. Pat. Appl. Ser. No. 08/992,057, filed Dec. 17, 1997 entitled "BELT FUSING ACCESSORY WITH SELECTABLE FUSED IMAGE GLOSS" in the name of Muhammed Aslam et al.

U.S. Pat. Appl. Ser. No. 08/992,643, filed Dec. 17, 1997 entitled "BELT FUSER APPARATUS FOR PREVENTING LINE ART TYPE MARKING PARTICLE OFFSET" in the name of Muhammed Aslam et al.

U.S. Pat. Appl. Ser. No. 08/992,058, filed Dec. 17, 1997 entitled "APPLICATION OF CLEAR TONER DEVELOPED NEGATIVE TO THE IMAGE IN AN ELECTROPHOTOGRAPHIC PROCESS TO ELIMINATE IMAGE RELIEF AND DIFFERENTIAL GLOSS ARTIFACTS" in the name of William J. Staudenmayer et al.

U.S. Pat. Appl. Ser. No. 08/992,746, filed Dec. 17, 1997 entitled "APPLICATION OF CLEAR MARKING PARTICLES TO IMAGES WHERE THE MARKING PARTICLE COVERAGE IS UNIFORMLY DECREASED TOWARDS THE EDGES OF THE RECEIVER MEMBER" in the name of Muhammed Aslam et al.

U.S. Pat. Appl. Ser. No. 08/992,056, filed Dec. 17, 1997 entitled "MECHANISM FOR TRACKING THE BELT OF A BELT FUSER" in the name of Muhammed Aslam et al.

U.S. Pat. Appl. Ser. No. 08/992,059, filed Dec. 17, 1997 entitled "A COLLAPSIBLE CUSTOMER REPLACEABLE BELT FUSER ASSEMBLY DESIGNED FOR ACCESSIBILITY, SERVICEABILITY, AND FUSING BELT REPLACEMENT" in the name of Muhammed Aslam et al.

U.S. Pat. Appl. Ser. No. 08/992,745, filed Dec. 17, 1997 entitled "APPARATUS FOR PACKAGING AND INSTALLATION OF A FUSING BELT" in the name of Muhammed Aslam et al.

FIELD OF THE INVENTION

This invention is directed in general to a fusing apparatus for a reproduction apparatus, and more particularly to a belt fusing apparatus of improved operating efficiency, wherein warmed cooling air is used to pre-heat the fusing belt.

BACKGROUND OF THE INVENTION

Typical commercial reproduction apparatus include electrostatographic process copier/duplicators or printers, inkjet printers, and thermal printers. With such reproduction apparatus, pigmented marking particles, ink, or dye material (hereinafter referred to commonly as marking particles) are utilized to develop an image, of information to be reproduced, on a dielectric support member for transfer to a receiver member, or directly onto a receiver member. The receiver member bearing the marking particle image is transported through a fuser device where the image is fixed (fused) to the receiver member, for example, by heat and pressure to form a permanent reproduction thereon. While the fuser device is typically integral with the reproduction apparatus, it may also be an independent piece of equipment, generally referred to as an off line fuser. Off line fusers, being a device devoted to a single task, have the ability to be optimized to perform the fusing function.

Certain reproduction apparatus have been designed to produce multi-color copies. In such reproduction apparatus, multiple color separation images are respectfully developed with complimentary colored marking particles, in superposition on a receiver member. It has been found that fixing of multi-color marking particle images to a receiver member requires substantially different operating parameters than fixing standard black marking particle images to a receiver member. Moreover, the respective operating parameters may in fact be in contradistinction. That is, multi-color images require a high degree of glossiness for a full, rich depth of color reproduction; on the other hand, since glossiness for black marking particle images may significantly impair legibility, a matte finish is preferred.

It is known that the glossiness of a marking particle image is, at least in part, dependent upon the marking particle melting characteristics in the fixing process. In general, the fixing apparatus serves to soften or at least partially melt the marking particles, enabling the marking particles to permeate into the fibers of the receiver member so that the marking particles are fixed to the receiver member to give a glossy image reproduction. For example, the fixing apparatus may include a heated roller which contacts the marking particles and the receiver member. With multi-color marking particle images, the multiple color marking particle images are respectively melted and fixed by the heated roller. If the color marking particle images are not sufficiently melted, light scattering cavities may occur in the copy which degrades the color reproduction. Moreover, if the marking particles on the receiver member do not have a mirror-like surface, incident light is reflected by diffusion from the marking particle surface and is not admitted into the marking particle layers, making the colors on the receiver member appear dark and cloudy. Therefore, low melting point marking particles are used. They yield few cavities and a hard flat surface so as to give glossy and vivid colors in the reproduction.

Low melting point marking particles are subject to increased image offset to the heating roller. This can produce undesirable defects in the reproduction or subsequent reproductions. Although image offset can be reduced by application of fuser oil to the heating roller, the use of such oil introduces further complications into the fusing system, such as handling of the oil and making sure that the layer of oil on the roller is uniform for uniform heat application. Alternatively, a mechanical arrangement for reducing image offset, without the need for fuser oil, has been found. Such mechanical arrangement, as shown for example in U.S. Pat. No. 5,256,507 (issued Oct. 26, 1993, in the name of Aslam et al), provides an elongated web which is heated to melt the marking particles and then cooled to cool the particles and facilitate ready separation of the receiver member with the marking particle image fixed thereto from the elongated web. The nature of operation of the elongated web arrangement also serves to increase the glossiness of the fixed marking particle image. As a result, such arrangement is particularly useful for multi-color image fusing.

Another web type fusing system is shown in U.S. Pat. No. 5,157,477, issued Oct. 20, 1992, in the names of Farnand et al. In this arrangement, a roller heat exchange device is provided as an auxiliary mechanism to remove heat from the web in the cooling portion and return the heat to the web before the web enters the fusing nip. As such two devices are required to provide reasonably efficient operation of this fusing apparatus.

SUMMARY OF THE INVENTION

In view of the above, this invention is directed to a belt fusing apparatus, for a reproduction apparatus, the belt fusing apparatus providing improved operating efficiency, wherein heated cooling air is used to pre-heat the fusing belt. The belt fusing apparatus, as disclosed, includes a heated fuser roller, a pressure roller in nip relation with the fuser roller, and a steering roller. A fusing belt is entrained about the fuser roller and the steering roller for movement in a predetermined direction about a closed loop path. A cooling air flow is directed at the fusing belt over an area adjacent to the steering roller upstream of the steering roller. The cooling air flow, heated by the action of the air flow cooling the fusing belt, is captured and directed at the fusing belt downstream of the steering roller to preheat the fusing belt.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
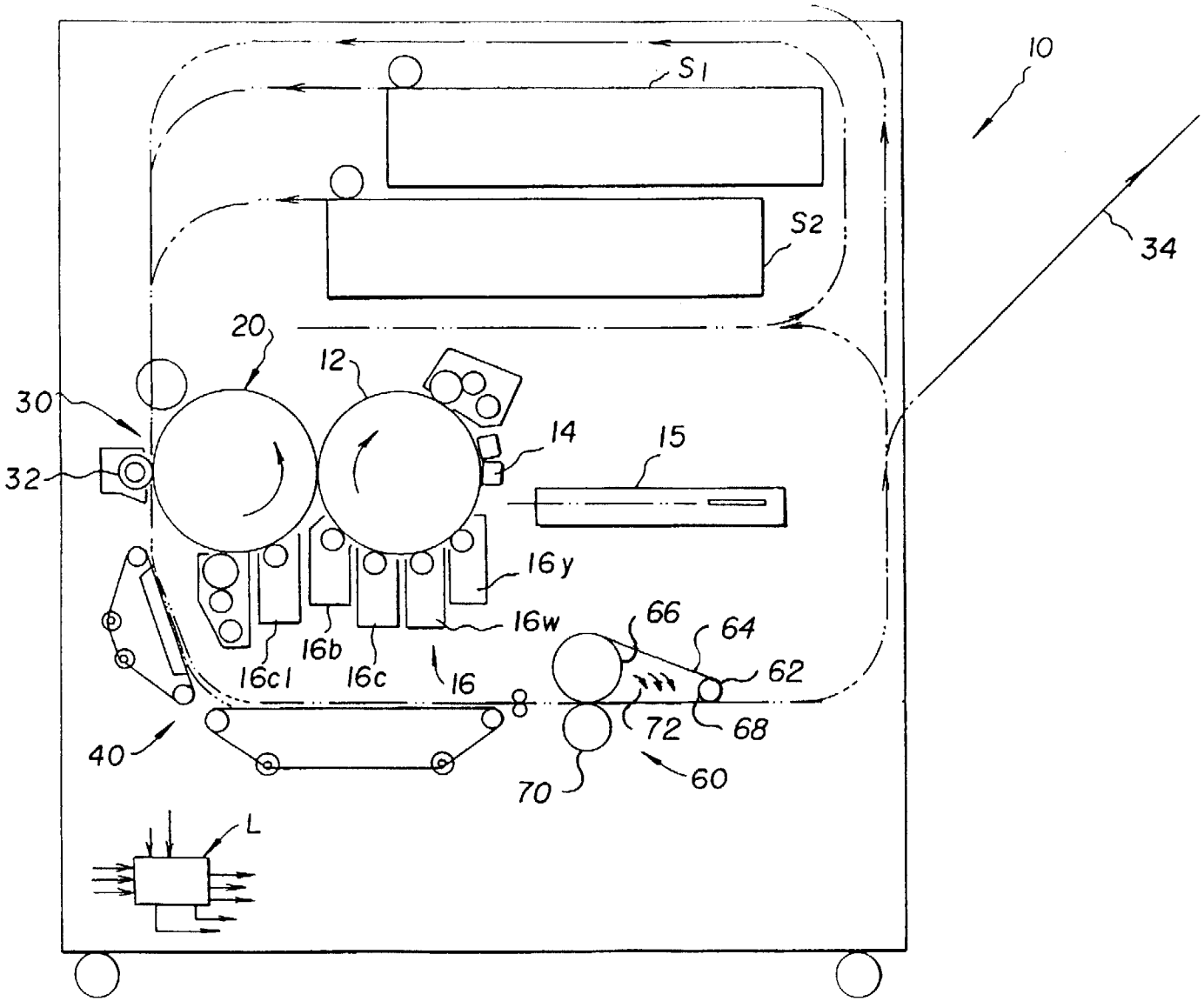
FIG. 1 is a front elevational view of an electrostatographic reproduction apparatus including a belt fusing apparatus, according to this invention, for providing improved operating efficiency.

Referring now to the accompanying drawings, an electrostatographic reproduction apparatus, designated generally by the numeral 10, is shown in FIG. 1. While the reproduction apparatus 10 is shown as an electrophotographic type reproduction apparatus, it is readily appreciated that the belt fusing apparatus according to this invention is suitable for use with other types of reproduction apparatus, such as ink jet printers and thermal printers.

The reproduction apparatus 10 includes a primary image forming dielectric member, for example, a drum 12 having a photoconductive surface, upon which a pigmented marking particle image, or series of different color marking particle images, is formed. In order to form images, when the photoconductive drum 12 is rotated in the direction of the arrow associated therewith, the photoconductive surface of drum is uniformly charged by charger 14, and then exposed imagewise by, for example, a laser 15 or light emitting diode (LED) array, to create a corresponding latent electrostatic image. The latent electrostatic image is developed by application of pigmented marking particles to the image bearing drum 12 by a development station 16. In the embodiment of the reproduction apparatus 10 as shown, there are five developing units, each unit having particular different color marking particles associated respectively therewith. Specifically, developing unit 16*y* contains yellow marking particles, developing unit 16*m* contains magenta marking particles, developing unit 16*c* contains cyan marking particles, and developing unit 16*b* contains black marking particles. Of course, other color marking particles (e.g. red, green, blue, etc.) may be used in the particular developing units depending upon the overall arrangement of the development station 16 and operational characteristics of the color development scheme for the reproduction apparatus 10. Additionally, a developing unit 16*cl* is provided, containing clear marking particles, which is utilized to aid in improving the quality and gloss of reproduced images, in the manner more fully described in the copending U.S. Pat. App. Ser. No. 08/992,872, filed on even date herewith.

Each developer unit is separately activated for operative developing relation with drum 12 to apply different color marking particles respectively to a series of images carried on drum 12 to create a series of different color marking particle images. The developed marking particle image is transferred (or multiple marking particle images are transferred one after another in registration) to the outer surface of a secondary or intermediate image transfer member, for example, an intermediate transfer drum 20. Thereafter, the single marking particle image, or a multicolor image comprising multiple marking particle images respectively formed on the surface of the intermediate image transfer member drum 20, is transferred in a single step to a receiver member.

The receiver member is transported along a path (designated by chain-link lines) into a nip 30 between intermediate image transfer member drum 20 and a transfer backing member, for example a roller 32. The receiver member is delivered from a suitable receiver member supply (hopper $S_1$ or $S_2$) into nip 30 where it receives the marking particle image. The receiving member exits the nip 30, and is transported by transport mechanism 40 to a fuser assembly 60 where the marking particle image is tacked to the receiver member by application of heat and/or pressure. After tacking the image to the receiver member, the receiver member is selectively transported to return to the transfer nip 30 to have a second side (duplex) image transferred to such receiver member, to a remote output tray 34 for operator retrieval, or to an output accessory.

Appropriate sensors (not shown) of any well known type, such as mechanical, electrical, or optical for example, are utilized in the reproduction apparatus 10 to provide control signals for the apparatus. Such sensors are located along the receiver member travel path and are associated with the primary image forming member photoconductive drum 12, the intermediate image transfer member drum 20, the transfer backing member roller 32, and various image processing stations. As such, the sensors detect the location of a receiver member in its travel path, and the position of the primary image forming member photoconductive drum 12 in relation to the image forming processing stations, and respectively produce appropriate signals indicative thereof. Such signals are fed as input information to a logic and control unit L including a microprocessor, for example. Based on such signals and a suitable program for the microprocessor, the unit L produces signals to control the timing operation of the various electrographic process stations for carrying out the reproduction process. The production of a program for a number of commercially available microprocessors, which are suitable for use with the invention, is a conventional skill well understood in the art. The particular details of any such program would, of course, depend on the architecture of the designated microprocessor.

The belt fusing apparatus 60, according to this invention, is shown as being integral with the reproduction apparatus 10. The belt fusing apparatus 60 includes an input transport for delivering marking particle image-bearing receiver members to a fusing assembly, designated generally by the numeral 62. The fusing assembly 62 comprises a fusing belt 64 entrained about a heated fusing roller 66 and a steering roller 68, for movement in a predetermined direction about a closed loop path. The fusing belt 64 is, for example, a thin metallic or heat resistant plastic belt. Metal belts can be electroformed nickel, stainless steel, aluminum, copper or other such metals, with the belt thickness being about 2 to 5 mils. Seamless plastic belts can be formed of materials such as polyimide, polypropylene, or the like, with the belt thickness summarily being about 2 to 5 mils. Usually these fusing belts are coated with thin hard coatings of release material such as silicone resins, fluoropolymers, or the like. The coatings are typically thin (1 to 10 microns), very smooth, and shiny. Such fusing belts could also be made with some textured surface to produce images of lower gloss or texture.

Figure 2:
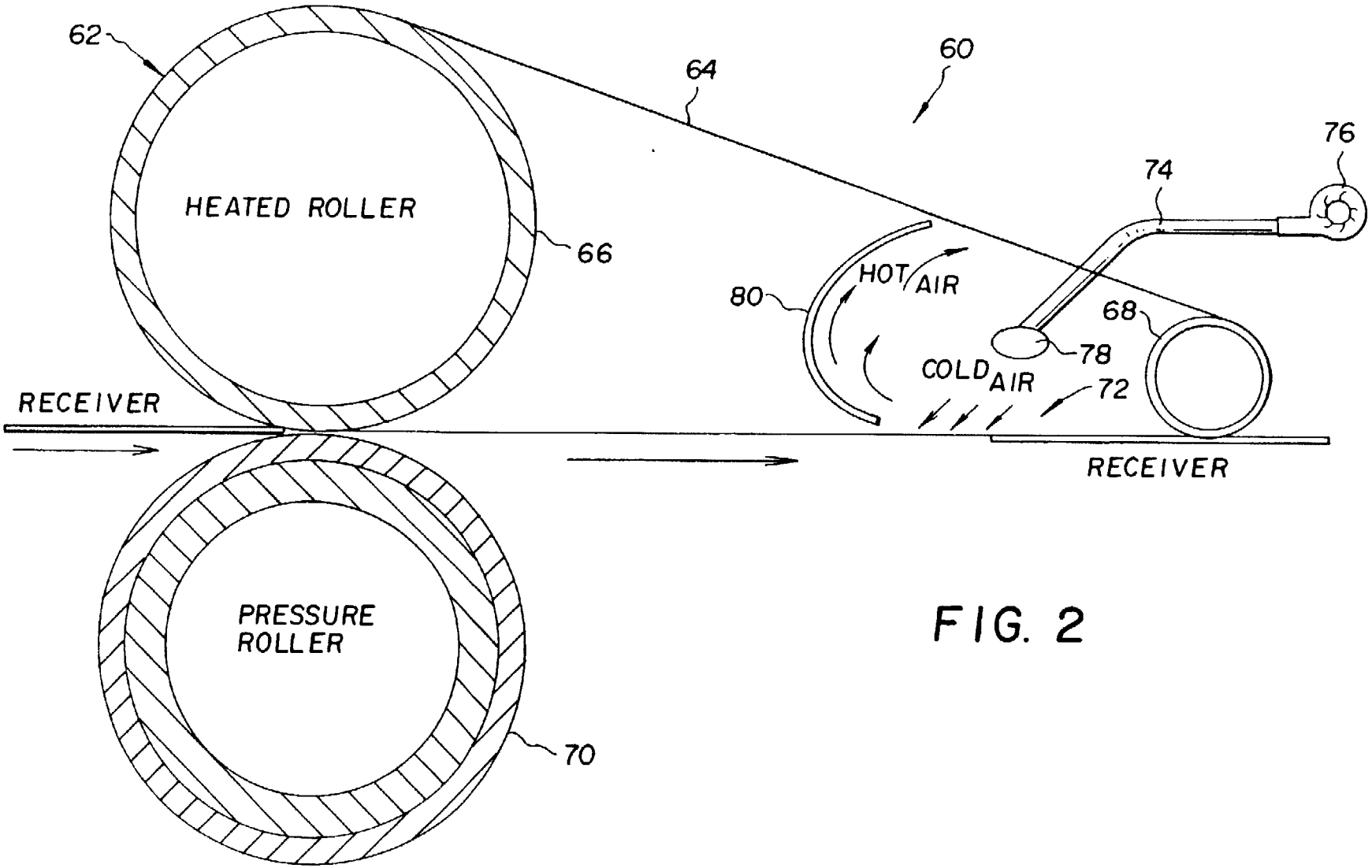
FIG. 2 is a front elevational view, on an enlarged scale, of the belt fusing apparatus, according to this invention.

A pressure roller 70 is located in nip relation with the heated fusing roller 66. A flow of air is directed at the area 72 of the belt run upstream of the steering roller 68 and adjacent to the steering roller to cool such area. The cooling action provides for a commensurate cooling of a receiver member, bearing a marking particle image, while such member is in contact with the fusing belt 64. The cooling action for the receiver member serves as the mechanism to substantially prevent offset of the marking particle image to the pressure roller. As shown in FIG. 2, the heated portion of the belt 64 is cooled by blowing cold air forced through a conduit 74 by a fan 76 to a ported air flow tube 78 to impinge on the belt, thus cooling the associated portion of the belt. Of course, an air knife or appropriate air nozzles are suitable for use with this invention. Air which has been heated due to the cooling action, is captured and deflected from the belt 64 towards the cooler portion of the belt (i.e., the downstream run of the fusing belt from the steering roller) by an air deflector 80. The captured heated air serves to preheat the belt 64 before it reaches the heated roller 66 of the fusing assembly 62. Using the energy from the heated air to preheat the belt 64 provides savings in total energy requirement to bring the fusing belt to the proper temperature for desired fusing, and thus helps to achieve higher fusing speed.

Figure 3:
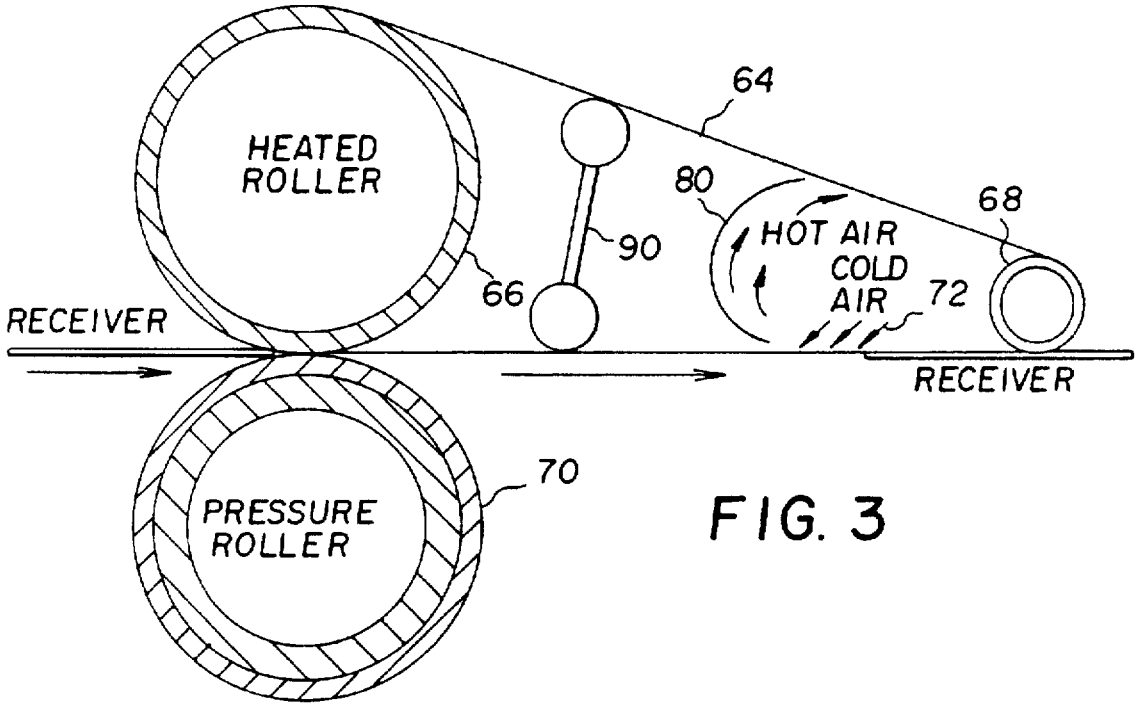
FIGS. 3 and 4 are respective front elevational views, on an enlarged scale, of alternate embodiments of the belt fusing apparatus, according to this invention.
Figure 4:
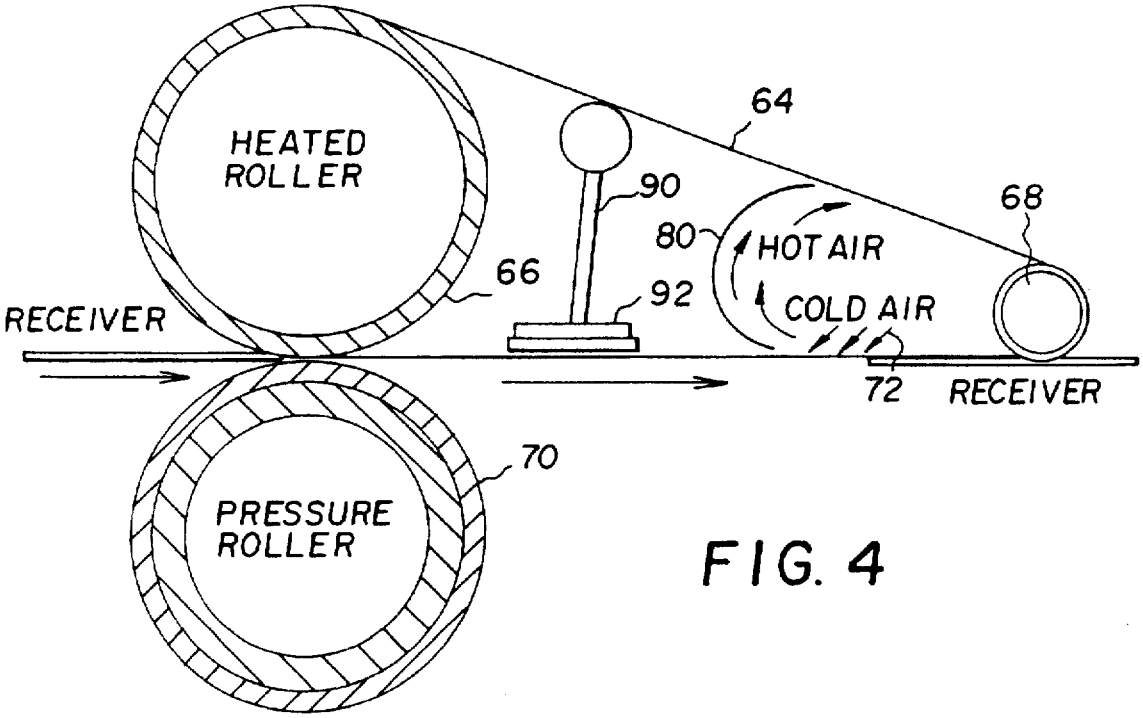

The cooler/deflector device, described above, could also be used with a heat pipe 90 as shown in FIG. 3. The heat pipe 90 would act as a passive mechanism for heat transport and further cooling. In case further increase in process speed is required, a thermoelectric cooler 92, in conjunction with a heat pipe 90 and forced air deflector 80 could be used as shown in FIG. 4.

The invention has been described in detail with particular reference to certain preferred embodiments thereof, but it will be understood that variations and modifications can be effected within the spirit and scope of the invention.

What is claimed is:

1. A belt fusing apparatus for providing image gloss to a colorant image formed on a receiver member by a reproduction apparatus, said belt fusing apparatus comprising:

a heated fuser roller;

a pressure roller in nip relation with said fuser roller;

a steering roller;

a fusing belt entrained about said fuser roller and said steering roller for movement in a predetermined direction about a closed loop path;

an air source for directing a cooling air flow at the interior surface of said fusing belt over an area adjacent to said steering roller upstream of said steering roller; and a shaped baffle, within said closed loop path, for capturing cooling air flow, heated by the action of the air flow cooling said fusing belt, and directing said captured air flow at the interior surface of said fusing belt downstream of said steering roller to preheat said fusing belt.

2. The belt fusing accessory of claim 1 wherein said air source further includes a ported air delivery tube, and a conduit connected to said air source and said air delivery tube to provide air flow communication therebetween.

3. The belt fusing accessory of claim 1 wherein said air source further includes a nozzle arrangement, and a conduit connected to said air source and said nozzle arrangement to provide air flow communication therebetween.

4. The belt fusing accessory of claim 1 wherein said air source further includes an air knife, and a conduit connected to said air source and said air knife to provide air flow communication therebetween.

5. The belt fusing accessory of claim 1 further including a heat pipe for transferring heat from said fusing belt substantially immediately downstream of said fuser roller to said fusing belt substantially immediately upstream of said fuser roller.

6. The belt fusing accessory of claim 1 further including a thermoelectric cooler for transferring heat from said fusing belt substantially immediately downstream of said fuser roller to said fusing belt substantially immediately upstream of said fuser roller.

* * * * *